US005720178A

United States Patent [19]

Silvetti et al.

[11] Patent Number: 5,720,178

[45] Date of Patent: Feb. 24, 1998

[54] REFRIGERATION SYSTEM WITH ISOLATION OF VAPOR COMPONENT FROM COMPRESSOR

[75] Inventors: Brian M. Silvetti, Tomkins Cove; Mark M. MacCracken, New York, both of N.Y.

[73] Assignee: Calmac Manufacturing Corporation, Englewood, N.J.

[21] Appl. No.: 679,813

[22] Filed: Jul. 15, 1996

[51] Int. Cl.[6] ..... F25B 41/04

[52] U.S. Cl. ..... 62/117; 62/509

[58] Field of Search ..... 62/117, 509

[56] References Cited

U.S. PATENT DOCUMENTS 2,794,328 6/1957 Herrick ..... 62/509

2,867,099 1/1959 Schubert ..... 62/509

4,179,898 12/1979 Vakil ..... 62/509

FOREIGN PATENT DOCUMENTS 877261 10/1981 U.S.S.R. ..... 62/509

*Primary Examiner*—William E. Tapolcai

*Attorney, Agent, or Firm*—Charles J. Brown

[57] ABSTRACT

In a vapor compression refrigeration system an improvement for isolating the compressor from work on a substantial component of refrigerant flashing to vapor upstream of the evaporator, wherein refrigerant liquid from the condenser is collected in a holding vessel from which it is intermittently emptied into an expansion device thereby generating flash vapor in the holding vessel which is prevented from passing through the expansion device and evaporator for return to the compressor.

2 Claims, 1 Drawing Sheet

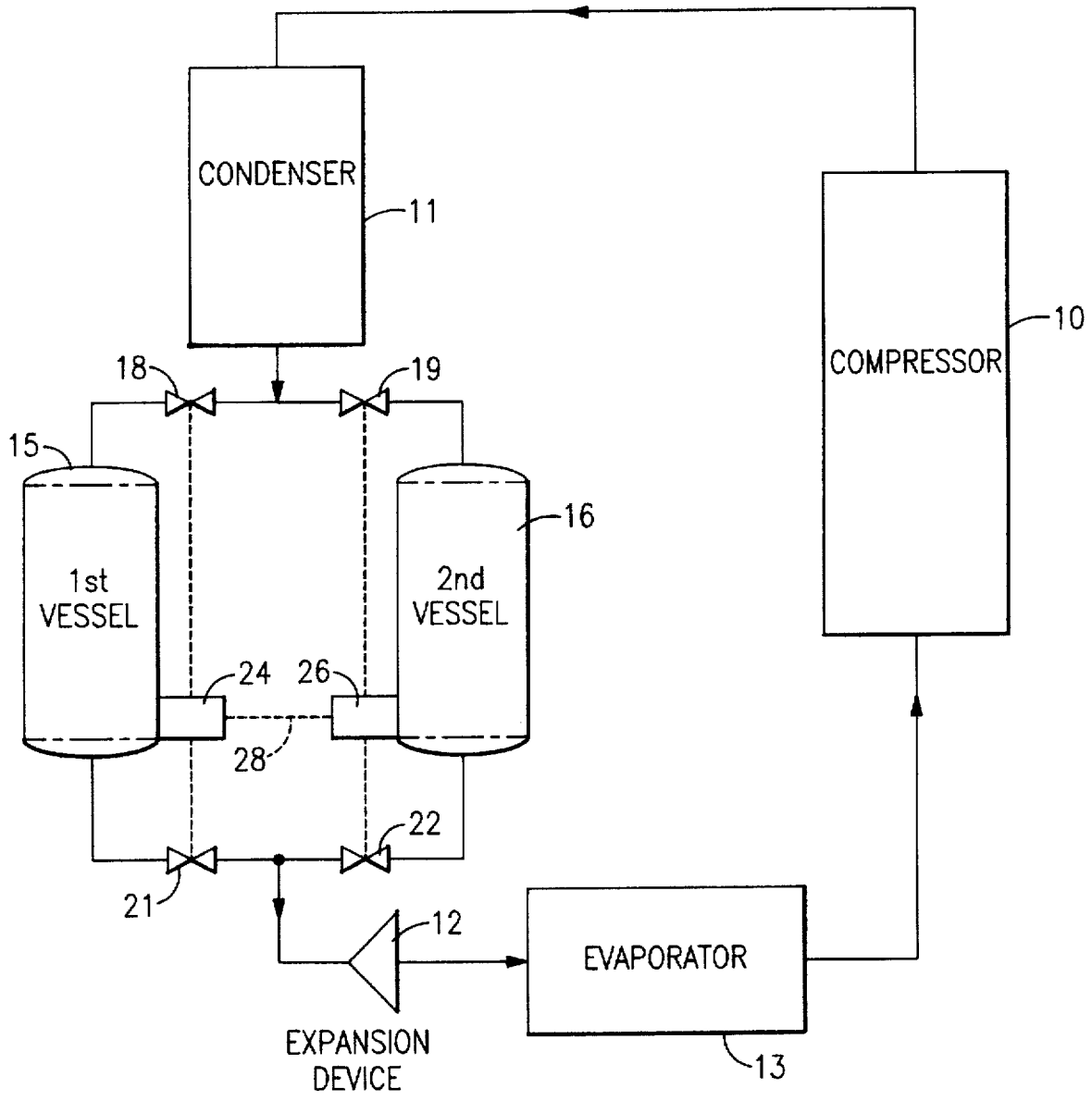
CONDENSER
11
COMPRESSOR
10
18
19
15
16
1st
VESSEL
2nd
VESSEL
24
26
28
22
21
12
EVAPORATOR
EXPANSION
DEVICE
13

REFRIGERATION SYSTEM WITH ISOLATION OF VAPOR COMPONENT FROM COMPRESSOR

BACKGROUND OF THE INVENTION

This invention concerns vapor compression refrigeration systems in which liquid refrigerants are evaporated to draw heat from some medium. It is conventional in such systems to circulate the refrigerant by means of a compressor which receives relatively low pressure refrigerant vapor from an evaporator heat exchanger where heat is drawn from the medium. The compressor discharges relatively high pressure vapor into a condenser which cools and liquifies the refrigerant. Typically high pressure liquid refrigerant then passes through an expansion device where some flash vapor forms. The refrigerant then continues principally in liquid phase but with some entrained flash vapor into the evaporator where the heat is drawn from the load medium.

It is known in the prior art to provide a receiver or holding vessel between the condenser and the expansion device and to subcool the pressurized liquid refrigerant after it leaves the holding vessel to increase cycle efficiency. It is characteristic of such systems that all of the refrigerant in the closed loop of the system passes through the compressor. In such conventional systems the flash vapor generated at the expansion device is carried into and through the evaporator so that the specific enthalpy of the total flow into the evaporator is unchanged from its level upstream of the expansion device. In the total refrigerant in the system, the compressor is called upon to expend work uselessly on that component of the total refrigerant represented by the flash vapor generated at the exit from the expansion device before being carried into and through the evaporator.

It is the principal purpose of the present invention to improve refrigeration system design by isolating the compressor from any work on any substantial component of the refrigerant which flashes to vapor upstream of the evaporator.

SUMMARY OF THE INVENTION

In accordance with the invention an improvement in cycle efficiency is made in a refrigeration cycle wherein a refrigerant vapor is pressurized in a compressor and then liquified in a condenser after the pressurized liquid is directed through an expansion device into an evaporator to perform a heat transfer function and thereafter for return to the compressor as vapor. The improved method of the invention comprises collecting the pressurized liquid from the condenser in at least one holding vessel upstream of the expansion device. The pressurized liquid is then emptied from the holding vessel through the expansion device to generate flash vapor both in the holding vessel and exiting from the expansion device. The vapor generated in the holding vessel is prevented from passing through the expansion device. Cycle efficiency is thereby increased by limiting vapor entering the compressor to vapor generated in the expansion device and evaporator to the exclusion of vapor generated in the holding vessel.

As the refrigerant reaches the evaporator the holding vessel fills with refrigerant vapor generated form the liquid refrigerant emptied from the holding vessel. The energy required to produce this flash vapor in the holding vessel comes from the refrigerant itself. Since this vapor must exist at a higher specific enthalpy than the liquid refrigerant that originally filled the vessel, conservation of energy requires that the flow entering the evaporator is reduced in specific enthalpy, thereby increasing its refrigerating effect. Each pound of refrigerant flowing through the evaporator has more cooling capacity than in a corresponding conventional cycle. The vapor that is separated from the refrigerant within the holding vessel upstream of the expansion device does not have to be recompressed by the compressor. Less of the compressor's available capacity is dedicated to compression of flash vapor instead is used principally to compress that vapor generated in the expansion device and evaporator. The vapor generated in the holding vessel upstream of the expansion device in effect lowers the average discharge pressure for the compressor thus resulting in a reduction in the total work of compression.

In a preferred form of the method of the invention first and second holding vessels are connected in parallel between the condenser and the expansion device and the pressurized liquid is alternately collected in the first vessel while being emptied from the second vessel and then emptied from the first vessel while being collected in the second vessel so that refrigerant flow is continuous. First valving means may be provided between the condenser and the holding vessels and second valving means can be provided between the holding vessels and the expansion device for flowing refrigerant into the first vessel while the second vessel is being emptied and alternately into the second vessel while the first vessel is being emptied.

BRIEF DESCRIPTION OF THE DRAWING

The single drawing FIGURE illustrates the preferred form of the improved refrigeration system wherein first and second holding vessels are provided between the condenser and the expansion device.

DESCRIPTION OF PREFERRED EMBODIMENT

In this form of the refrigeration system of the invention, a refrigerant vapor is pressurized in a compressor 10 and is then liquified in a condenser 11. It is conventional that the pressurized liquid is directed through an expansion device 12, such as an expansion valve, into an evaporator 13 where the refrigerant performs its heat transfer function with respect to a load. The refrigerant leaves the evaporator 13 as a vapor and returns to the compressor 10.

In accordance with the invention, first and second holding vessels 15 and 16 are connected in parallel between the condenser 11 and the expansion device 12. A first upstream valve 18 is provided between the condenser 11 and the first vessel 15 and a second upstream valve 19 is provided between the condenser 11 and the second vessel 16. A first downstream valve 21 is provided between the first vessel 15 and the expansion device 12 and a second downstream valve 22 is provided between the second vessel 16 and the expansion device 12. A conventional first liquid level sensor 24 is associated with the first vessel 15 to send signals to the first valves 18 and 21 when the liquid level in the first vessel 15 falls to a certain minimum. Similarly, a second liquid level sensor 26 is associated with the second vessel 16 to send signals to the second valves 19 and 22 when the liquid level in the second vessel 16 falls to a certain minimum. The sensors 24 and 26 are also interconnected as indicated by the dotted line 28 to send signals to one another.

The operation of the system will now be described starting with a condition wherein the first vessel 15 is almost emptied and the second vessel 16 is almost filled. When the liquid level in the first vessel 15 falls to the predetermined minimum the first sensor 24 signals the first upstream valve 18 to open and the first downstream valve 21 to close. A signal is also sent to the sensor 26 associated with the second vessel 16 to cause the second upstream valve 19 to close and the second downstream valve 22 to be opened. Consequently refrigerant liquid begins filling the first vessel 15 while it empties from the second vessel 16. When the liquid level in the second vessel 16 is depleted the second sensor 26 causes the operation of the valves to be reversed, which is to say the first upstream valve 18 is closed and the first downstream valve 21 is opened so that the first vessel 15 empties its contents through the expansion device 12. At the same time the second upstream valve 19 is opened while the second downstream valve 22 is closed so that the second vessel 16 is refilled with the refrigerant liquid.

As each of the first and second vessels 15 and 16 is alternately emptied and the refrigerant therein passes through the expansion device 12, flash vapor is generated both inside the respective holding vessel being emptied and at the exit of the expansion device 12. Flash vapor generated inside the respective holding vessels 15 and 16 is thereby prevented from passing through to the expansion device. Consequently the vapor entering the compressor 10 is limited to the vapor generated at the exit of the expansion device 12 and in the evaporator 13 to the exclusion of vapor generated in either of the holding vessels 15 or 16. Put another way, the compressor 10 is never called upon to recompress that component of vapor which is self-generated from the refrigerant within the holding vessels upstream of the expansion device 12. This in effect lowers the average discharge pressure for the compressor 10 and results in a reduction in the total work of compression. Moreover, the refrigerant which the compressor is called upon to move has an increased refrigerating effect because it enters the evaporator 13 at a lower average enthalpy than in a conventional system.

The scope of the invention is to be determined from the following claims rather than from the foregoing description of a preferred embodiment. For example, a single holding vessel may be utilized which results in intermittent refrigerant flow, or two holding vessels could be arranged in series.

We claim:

1. In a refrigeration cycle wherein a single refrigerant in vapor form is pressurized in a compressor and then liquified in a condenser after which the pressurized liquid is directed through an expansion device into an evaporator to perform a heat transfer function and thereafter is returned to the compressor as vapor, with first and second holding vessels connected in parallel between the condenser and the expansion device, each vessel having its own upstream and downstream valving means, a method of improving cycle efficiency which comprises a) collecting the pressurized liquid from the condenser in the first holding vessel by opening its upstream valving means and closing its downstream valving means while simultaneously substantially emptying the pressurized liquid from the second holding vessel by closing its upstream valving means while opening its downstream valving means thereby generating flash vapor in the second holding vessel, and then collecting the pressurized liquid in the second holding vessel by opening its upstream valving means while closing its downstream valving means while simultaneously substantially emptying the pressurized liquid from the first holding vessel by closing its upstream valving means while opening its downstream valving means thereby generating flash vapor in the first holding vessel; and b) preventing said flash vapor generated alternately in the first and second holding vessels from passing through to said expansion device by the respective alternate closings of the respective downstream valving means;

c) whereby cycle efficiency is increased by limiting vapor entering the compressor to vapor generated in the expansion device and the evaporator to the exclusion of vapor generated in the first and second holding vessels.

2. A method according to claim 1 wherein the alternate openings and closings of the respective valving means are timed so that refrigerant is substantially continuously flowing into and out of the respective holding vessels.

* * * * *